US007767293B2

(12) United States Patent
Kanagawa et al.

(10) Patent No.: US 7,767,293 B2
(45) Date of Patent: Aug. 3, 2010

(54) LEATHER-LIKE SHEET

(75) Inventors: Yoshinori Kanagawa, Osaka (JP); Toshio Niwa, Osaka (JP); Toshifumi Tamaki, Osaka (JP); Minoru Takahashi, Osaka (JP)

(73) Assignee: DIC Corporation, Tokyo (JP)

( * ) Notice: Subject to any disclaimer, the term of this patent is extended or adjusted under 35 U.S.C. 154(b) by 0 days.

(21) Appl. No.: 12/447,704

(22) PCT Filed: Nov. 19, 2007

(86) PCT No.: PCT/JP2007/072356

§ 371 (c)(1),
(2), (4) Date: Apr. 29, 2009

(87) PCT Pub. No.: WO2008/065920

PCT Pub. Date: Jun. 5, 2008

(65) Prior Publication Data

US 2010/0068499 A1 Mar. 18, 2010

(30) Foreign Application Priority Data

Dec. 1, 2006 (JP) ..... 2006-325684

(51) Int. Cl.
*B32B 5/18* (2006.01)
*B32B 27/40* (2006.01)
*C08L 75/00* (2006.01)
*C08L 63/00* (2006.01)

(52) U.S. Cl. ..... 428/318.6; 428/339; 428/423.1; 522/173; 522/170

(58) Field of Classification Search ..... 428/318.6, 428/339, 423.1; 522/170, 173
See application file for complete search history.

(56) References Cited

U.S. PATENT DOCUMENTS 5,391,665 A 2/1995 Matsunaga et al.
6,825,268 B2 * 11/2004 Maier et al. ..... 524/840

FOREIGN PATENT DOCUMENTS

| | | | |
|---|---|---|---|
| CA | 2381628 | A | 2/2001 |
| EP | 1731658 | A1 | 12/2006 |
| JP | 05-262808 | A | 10/1993 |
| JP | 2003-507219 | A | 2/2003 |
| JP | 2005-273131 | A | 10/2005 |
| JP | 2005-307133 | A | 11/2005 |
| JP | 2005-325474 | A | 11/2005 |
| JP | 2006-152142 | A | 6/2006 |

* cited by examiner

*Primary Examiner*—Thao T. Tran
(74) *Attorney, Agent, or Firm*—Edwards Angell Palmer & Dodge LLP

(57) ABSTRACT

A leather-like sheet is provided having a substrate layer and a surface skin layer in which the surface skin layer is composed of a cross-linked product of a polyurethane hot-melt composition containing 100 parts by mass of a urethane prepolymer, 5 parts by mass to 40 parts by mass of a coloring agent containing a polyol, 5 parts by mass to 50 parts by mass of multi-functional (meth)acrylate, and 0.5 parts by mass to 5 parts by mass of a photopolymerization initiator, wherein the urethane prepolymer can be obtained by reacting 5% to 50% of the number of isocyanate groups in a urethane prepolymer containing isocyanate groups that is obtained by reacting a polyol containing 40% by mass or more of polytetramethylene glycol and a polyisocyanate with a (meth)acrylate containing a hydroxyl group. This leather-like sheet has an excellent surface grade while maintaining excellent suppleness and bending resistance.

8 Claims, 1 Drawing Sheet

LEATHER-LIKE SHEET

CROSS REFERENCE TO PRIOR RELATED APPLICATIONS

This application is a U.S. national phase application under 35 U.S.C. §371 of International Patent Application No. PCT/JP2007/072356, filed on Nov. 19, 2007, and claims the benefit of Japanese Patent Application No. 2006-325684, filed on Dec. 1, 2006, both of which are incorporated by reference herein. The International Application was published in Japanese on Jun. 5, 2008, as International Publication No. WO 2008/065920 A 1 under PCT Article 21(2).

FIELD OF THE INVENTION

The present invention relates to a leather-like sheet that can be used in footwear such as women's shoes, sport shoes, and sandals, and in furniture, clothes, etc.

BACKGROUND OF THE INVENTION

A leather-like sheet such as an artificial leather and a synthetic leather is used in wide usage such as footwear and clothes. A basic configuration of the leather-like sheet is a layered structure composed of a surface skin layer, an adhesive layer, and a substrate layer; and a layer that is a basic fabric such as a nonwoven fabric or a woven fabric, a layer in which these basic fabrics are immersed in a resin such as a polyurethane resin, or a layer in which a porous layer composed of a resin such as a polyurethane resin is provided on the surface of the basic fabric, etc. is used as the substrate layer.

The leather-like sheet is conventionally manufactured, for example, by (1) a method of forming a surface skin layer having a leather-like uneven pattern by applying an organic solvent solution of a polyurethane resin onto a substrate layer with a gravure method, etc., drying and removing the organic solvent, and then pressing its coated surface using an embossing roll, etc., and (2) a method of laminating a surface skin layer onto a substrate layer with an adhesive, etc., where the surface skin layer is obtained by applying an organic solvent solution of a polyurethane resin onto a release paper having a leather-like uneven pattern, drying, and removing the organic solvent.

However, because a step of removing the organic solvent in the middle of the manufacturing of the leather-like sheet is necessary in the method of using the organic solvent solution of a polyurethyane resin as described above in the formation of the surface skin layer, there have been various problems such as a bad influence on the human body due to the organic solvent, contamination of the atmosphere and water, and a large energy load and manufacturing cost to evaporate the organic solvent.

As a method of solving the problems, a method of using an aqueous polyurethane resin in place of the organic solvent type polyurethane resin has been investigated. However, because a leather-like sheet having a surface skin layer that is formed using an aqueous polyurethane resin is generally inferior, for example, in water resistance and durability, it is true that practicality is poor and the application range of the aqueous polyurethane is extremely limited.

Then, a technique has been proposed of using a non-solvent type hot-melt urethane resin that does not substantially contain a solvent such as an organic solvent or water in place of the organic solvent type polyurethane resin.

For example, a leather-like sheet having a surface skin layer that is formed on a fibrous substrate using a moisture-curable polyurethane hot-melt resin composition containing a hot-melt urethane prepolymer having an isocyanate group in its molecule end and a coloring agent has been known to be excellent in designability, feeling, wear resistance, and suppleness as a leather-like sheet using the non-solvent type hot-melt urethane resin (for example, refer to Japanese Patent Laying-Open No. 2005-273131 ("JP '131")).

In many cases of manufacturing a leather-like sheet using the non-solvent type hot-melt urethane resin as described above, a step of carrying out curing sufficiently is necessary by applying the non-solvent type hot-melt urethane resin onto a release paper, adhering a fibrous substrate onto the coated surface, winding the laminated body that is obtained by removing the release paper into a roll, and leaving it for a prescribed time.

However, because the winding into a roll is performed before the non-solvent type hot-melt urethane resin constituting the surface skin layer is cured completely in many cases, there is a problem that fuzz is generated on the surface of the surface skin layer and the surface grade of the leather-like sheet deteriorates in the case where the releasability between the surface skin layer and the back side of the leather-like sheet to which the surface skin layer contacts is poor when unwinding.

Here, because suppression of the fuzz generation described above is not considered in the moisture-curable polyurethane hot-melt resin composition described in JP '131, there was a case that fuzz is generated on the surface of the surface skin layer in the case of manufacturing a leather-like sheet using such composition.

In the meantime, it is expected that the non-solvent type hot-melt urethane resin whose application to the surface skin layer of the leather-like sheet is known will be developed into broad use as an adhesive, a coating agent and the like for construction materials and for fibers, etc., as an environmentally responsive, high added value product replacing the conventional solvent type resin and an aqueous resin.

A hot-melt urethane resin containing an isocyanate group that forms a cross-linking structure by reacting with, for example, moisture (water) in the atmosphere is known as such a hot-melt urethane resin. However, in recent years, a hot-melt urethane resin having both an isocyanate group that contributes to a cross-linking reaction by moisture and a polymerizable unsaturated bond that contributes to the cross-linking reaction by ultraviolet ray irradiation has attracted attention.

Specifically, a resin composition is known having an urethane(meth)acrylate resin that is obtained by reacting a polyisocyanate compound (a) having two or more isocyanate groups per molecule, at least one or more type of polyols (b) selected from polyesterpolyol, polycaprolactonepolyol, polyetherpolyol, and polycarbonatepolyol, and (meth)acrylate containing a hydroxyl group (c) under a condition that (the number of isocyanate groups in (a))>(the total number of hydroxyl groups in (b) and (c)) as a constituent component, wherein a concentration of a (meth)acryloyl group is 0.1 equivalent /kg to 2.0 equivalent /kg, and a concentration of an isocyanate group is 0.05 equivalent /kg or more (for example, refer to Japanese Patent Laying-Open No. 2005-307133 ("JP '133")).

Further, a reactive hot-melt paint composition is known that contains an oligomer component having crystallinity and a melting point of 10° C. to 100° C. and a photoradical polymerization initiator of 1% by mass to 10% by mass based on the oligomer component, and that is a solid or a solid solution at 20° C. to 50° C. (for example, refer to Japanese Patent Laying-Open No. 2006-152142 ("JP '142")).

The resin composition described in JP '133 is mainly used in the coating of a wooden base material, a plastic base material, and a paper base material, and the reactive hot-melt paint composition described in the Patent Document 3 is mainly used in the coating of a plywood and a bare wood product.

Therefore, even when such compositions are used in the surface skin layer of the leather-like sheet, it is difficult to suppress the fuzz generation on the surface skin layer (that is, the suppression of surface tack) to a sufficient practical level in addition to achieving an excellent suppleness and bending resistance that are required in the surface skin layer. Further, in any of JP '133 and JP '142, there is no description that the resin compositions can be used in the surface skin layer of the leather-like sheet.

As described above, it is difficult to obtain a leather-like sheet having a surface skin layer in which the fuzz generation is suppressed while maintaining an excellent suppleness, etc. with the techniques proposed in JP '131, JP '133, and JP '142.

SUMMARY OF THE INVENTION

The problem to be solved by the present invention is to provide a leather-like sheet having an excellent surface grade in which fuzz generation is suppressed by decreasing surface tack of a surface skin layer while maintaining an excellent suppleness and bending resistance, especially a good bending resistance in a low-temperature environment.

The present inventors carried out an investigation by using a urethane resin that is generally known to be capable of forming a layer having a supple feeling as a resin composition constituting the surface skin layer of the leather-like sheet as a basis.

Specifically, when a urethane resin that is obtained by reacting polyol containing polytetramethylene glycol and polyisocyanate such as 4,4-diphenylmethanediisocyanate for example is used in the surface skin layer in order to give further suppleness to the urethane resin, a surface skin layer having a supple feeling, a good bending resistance, etc. can be formed.

However, surface tack can be easily generated on the surface of the surface skin layer that is formed using the urethane resin due to the influence of the polytetramethylene glycol, and as a result, fuzz is generated that is caused by the surface tack when a laminated product of the base material and the surface skin layer are wound in a roll and rested, and then unwound.

The present inventors considered that such fuzz generation can be suppressed by using a resin that is capable of curing promptly as a resin constituting the surface skin layer, and investigated to use a resin with which an ultraviolet ray curing reaction that generally carries out the curing reaction promptly can be performed besides the moisture curing reaction to form the surface skin layer.

Specifically, when investigating to use a polyurethane hot-melt resin that contains a urethane prepolymer in which a polymerizable unsaturated bond that contributes to the ultraviolet ray curing reaction is given by modifying a part of the isocyanate groups of the urethane prepolymer containing isocyanate groups that contribute to the moisture curing reaction using, for example, (meth)acrylate containing a hydroxyl group, the problems were led to be solved.

That is, the present invention relates to a leather-like sheet having at least a substrate layer and a surface skin layer, wherein the surface skin layer is composed of a cross-linked product of a polyurethane hot-melt composition containing 100 parts by mass of a urethane prepolymer (A), 5 parts by mass to 40 parts by mass of a coloring agent (B) containing a polyol as a vehicle, 5 parts by mass to 50 parts by mass of multi-functional (meth)acrylate (C), and 0.5 parts by mass to 5 parts by mass of a photopolymerization initiator (D), and wherein the urethane prepolymer (A) is obtained by reacting 5% to 50% of the number of isocyanate groups in a urethane prepolymer containing isocyanate groups that is obtained by reacting a polyol (a1) containing 40% by mass or more of polytetramethylene glycol and a polyisocyanate (a2) with (meth)acrylate containing a hydroxyl group.

Because the leather-like sheet according to the present invention has an excellent surface grade by suppressing the fuzz generation on the surface skin layer, and is excellent in supple feeling, durability, and bend resistance, it can be used as an artificial leather and a synthetic leather that are used in manufacturing of shoes such as women's shoes, sport shoes, and sandals, and in furniture, clothes, etc.

DETAILED DESCRIPTION OF THE INVENTION

The leather-like sheet according to the present invention is a leather-like sheet having at least a substrate layer and a surface skin layer, and the surface skin layer is composed of a cross-linked product of a polyurethane hot-melt composition containing 100 parts by mass of a urethane prepolymer (A), 5 parts by mass to 40 parts by mass of a coloring agent (B) containing a polyol as a vehicle, 5 parts by mass to 50 parts by mass of multi-functional (meth)acrylate (C), and 0.5 parts by mass to 5 parts by mass of a photopolymerization initiator (D). The urethane prepolymer (A) can be obtained by reacting 5% to 50% of the number of isocyanate groups in a urethane prepolymer containing isocyanate groups that is obtained by reacting a polyol (a1) containing 40% by mass or more of polytetramethylene glycol and a polyisocyanate (a2) with (meth)acrylate containing a hydroxyl group.

Figure 1:
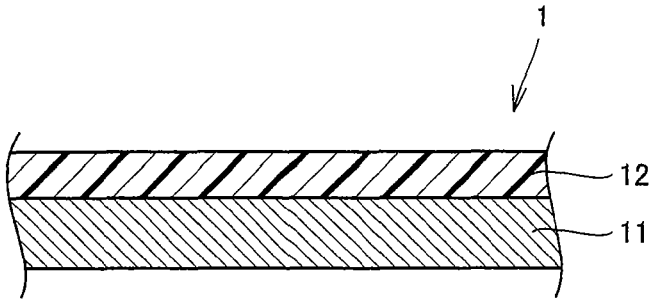
FIG. 1 is a cross-sectional view showing a basic configuration of a leather-like sheet according to the present invention.

FIG. 1 is a cross-sectional view showing a basic configuration of the leather-like sheet according to the present invention. As shown in FIG. 1, a leather-like sheet 1 has at least a substrate layer 11 and a surface skin layer 12 that is laminated on substrate layer 11.

Figure 2:
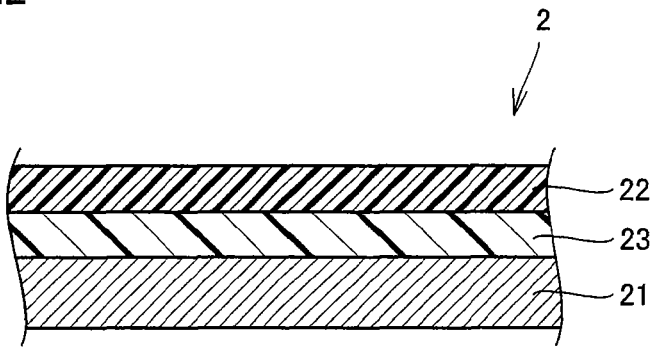
FIG. 2 is a cross-sectional view showing another configuration of the leather-like sheet according to the present invention.

Further, the leather-like sheet may further have an intermediate layer between the substrate layer and the surface skin layer in order to give a supple feeling, etc. In a leather-like sheet 2 shown in FIG. 2, a surface skin layer 22 is formed on a substrate layer 21 with an intermediate layer 23 interposed therebetween. The intermediate layer is preferably a porous layer.

First, the surface skin layer that configures the leather-like sheet according to the present invention will be described.

The polyurethane hot-melt composition that forms the surface skin layer that configures the leather-like sheet contains 100 parts by mass of a urethane prepolymer (A), 5 parts by mass to 40 parts by mass of a coloring agent (B) containing a polyol as a vehicle, 5 parts by mass to 50 parts by mass of multi-functional (meth)acrylate (C), 0.5 parts by mass to 5 parts by mass of a photopolymerization initiator (D), and other components depending on necessity.

The urethane prepolymer (A) can be obtained by reacting, with a (meth)acrylate containing a hydroxyl group, 5% to 50% of the number of isocyanate groups in a urethane prepolymer containing isocyanate groups that is obtained by reacting a polyol (a1) containing 40% by mass or more of polytetramethylene glycol and a polyisocyanate (a2). With this reaction, polymerizable unsaturated double bonds are introduced in a part of the molecule of the urethane prepolymer (A), especially a part of a molecular main chain skeleton.

The reaction of the urethane prepolymer containing isocyanate groups and the (meth)acrylate containing a hydroxyl group is necessarily performed with 5% to 50% of the number of the isocyanate groups in the urethane prepolymer, and preferably 10% to 30%.

By reacting the isocyanate groups in this range with the (meth)acrylate containing a hydroxyl group, the polymerizable unsaturated double bonds can be introduced in the urethane prepolymer (A) at an amount in which the curing speed of the polyurethane hot-melt composition can be improved at a desired level. Here, the number of isocyanate groups in the urethane prepolymer (A) can be obtained, for example, by reacting the isocyanate groups with dibutylamine by mixing the urethane prepolymer (A) and excessive dibutylamine, and then obtaining an amount of remaining dibutylamine with a back titration method using hydrochloric acid.

The urethane prepolymer (A) that can be obtained with the reaction is specifically preferably any forms of (i) a mixture of a urethane prepolymer (A1) having isocyanate groups at both molecular ends and a urethane prepolymer (A2) having polymerizable unsaturated double bonds at both molecular ends, or (ii) a single urethane prepolymer (A3) in which one of molecular ends is an isocyanate group and the other is the polymerizable unsaturated double bond, or a mixture of the urethane prepolymer (A3) and the urethane prepolymers (A1) or (A2).

By using the urethane prepolymer (A) in which both of the isocyanate group and the polymerizable unsaturated double bond exist as described above, a moisture curing reaction caused by the isocyanate group and a radical reaction by ultraviolet ray irradiation that is caused by the polymerizable unsaturated double bond smoothly proceed, and therefore, the curing speed of the polyurethane hot-melt composition can be improved remarkably. As a result, a leather-like sheet can be obtained in which the surface tack of the surface skin layer is decreased, the fuzz generation of the surface skin layer is suppressed, and the surface grade is excellent.

Further, the urethane prepolymer (A) has "a moisture curing property" as described above.

The moisture curing property of the urethane prepolymer (A) is a characteristic that is originated by a cross-linking reaction that starts by reacting the isocyanate group in the urethane prepolymer (A) with moisture (that is water) and that is caused by the isocyanate group.

By the effect of the moisture curing property of the urethane prepolymer (A), after applying the polyurethane hot-melt composition onto the substrate layer in a heat-melted state, the polyurethane hot-melt composition can be cured and made to have high molecular weight by reacting with moisture (that is water) in atmosphere or contained in the substrate layer. Thereby, a surface skin layer that is excellent in durability can be formed, and good adhesiveness between the surface of the substrate layer and the surface skin layer can be also obtained.

Further, the urethane prepolymer (A) has "an ultraviolet ray curing property" as described above. The ultraviolet ray curing property is originated by a radical polymerization reaction of the polymerizable unsaturated double bond in the urethane prepolymer (A) that is caused by a radical that is generated by photopolymerization initiator (D) with the ultraviolet ray irradiation.

Further, the urethane prepolymer (A) has "a hot-melt property."

The hot-melt property is a characteristic that is caused by the molecular structure of the prepolymer that is selected, and it is a characteristic that it is a viscous state at a level where the application onto a solid or a substrate layer is difficult at normal temperature, but it melts by heating and the application onto the substrate layer becomes possible, and it solidifies by cooling and adhesiveness appears. The word "hot-melt" in the present invention is used as a general term of the characteristic and a substance having such a characteristic.

The hot-melt property has a close relationship with softening point, where the lower the softening point is of urethane prepolymer that is generally used, the better the workability tends to become, and on the contrary, the higher the softening point is, the better the adhesive strength tends to become.

The softening point of the urethane prepolymer (A) that is used in the present invention is preferably in the range of 40° C. to 120° C. When the softening point of the urethane prepolymer (A) is in such a range, the workability is good, and a moisture curable polyurethane hot-melt adhesive that is excellent in adhesive strength can be obtained. Here, the softening point in the present invention refers to a temperature at which the urethane prepolymer starts to be thermally fluidized and to lose cohesion force when the temperature of the urethane prepolymer is gradually increased.

Further, glass transition temperature (Tg) of a cured product that is obtained by applying the urethane prepolymer (A) onto the substrate layer at 150 μm thickness and maturing for 5 days under an environment of an ambient temperature 23° C. and a relative humidity 65% is preferably in the range of −50° C. to 40° C., and more preferably −40° C. to 30° C. By using the urethane prepolymer (A) that is capable of forming the cured product that has the glass transition temperature in the range, a surface skin layer can be formed having excellent durability and mechanical strength and having excellent bending property and supple feeling in a low temperature environment. Here, the glass transition temperature is a value measured as a peak temperature (unit: ° C.) of a loss tangent (tan δ) that is obtained by measuring at a frequency of 1 Hz and a rising temperature speed of 5° C./min with a dynamic viscoelasticity measuring machine (manufactured by TA Instruments, Japan).

Further, many urethane prepolymers in general have a low molecular weight. However, ones having a number average molecular weight of several tens of thousands are also called urethane prepolymers by those skilled in the art, and the urethane prepolymer (A) in the present invention also includes one having a number average molecular weight of up to several tens of thousands, for example. The number average molecular weight of the urethane prepolymer (A) is preferably in the range of 500 to 10000, more preferably 1000 to 8000, and especially preferably in the range of 2000 to 6000. By using urethane prepolymer having a number average molecular weight in this range, a polyurethane hot-melt composition that is capable of forming a surface skin layer with good mechanical strength and durability can be achieved. Further, the mixing property of the urethane prepolymer (A) with other components such as the coloring agent (B) becomes good, and moreover the coatability of the polyurethane hot-melt composition becomes good. Here, the number average molecular weight is measured with a gel filtration chromatography (GPC) method, and it is a value that is calculated in terms of polystyrene.

The melt viscosity of the urethane prepolymer (A) at 125° C. that is measured using a cone plate viscometer is preferably in the range of 100 mPa·s to 30000 mPa·s, and more preferably in the range of 1000 mPa·s to 10000 mPa·s. By using urethane prepolymer (A) having a melt viscosity in this range, manufacturability of the polyurethane hot-melt composition and work stability when applying the composition onto the substrate layer become good. Further, the polyurethane hot-melt composition that is obtained using the urethane prepolymer (A) having a melt viscosity in this range can form a surface skin layer having good adhesive strength without penetrating into the substrate layer too much.

The urethane prepolymer containing isocyanate groups that is used in manufacturing of the urethane prepolymer (A) can be manufactured by reacting a polyol (a1) that contains polytetramethylene glycol at 40% by mass or more and a polyisocyanate (a2) in the condition that the number of isocyanate groups in the polyisocyanate (a2) becomes excessive to the amount of the hydroxyl groups in the polyol (a1), for example.

The polyol (a1) that is used in manufacturing of the urethane prepolymer containing isocyanate groups necessarily contains 40% by mass or more of polytetramethylene glycol based on the total amount of the polyol (a 1). By using a polymethylene glycol in the range, a leather-like sheet can be obtained that is equipped with a surface skin layer having excellent bending resistance and a supple feeling even under an environment of low temperature to normal temperature.

The polytetramethylene glycol is more preferably 60% by mass or more based on the total amount of the polyol (a1). Further, the upper limit of the content of the polytetramethylene glycol may be 100% by mass. However, it is preferably set to be 90% by mass or less, more preferably 80% by mass or less, and to use by combining with other polyols that are described later from the viewpoint of improving mechanical strength, adhesiveness, etc. of the surface skin layer that is formed.

The number average molecular weight of the polytetramethylene glycol is preferably in the range of 500 to 5000, and more preferably in the range of 1000 to 3000. By using polytetramethylene glycol in such a range, a surface skin layer having good mechanical strength can be formed without spoiling the supple feeling of the leather-like sheet.

The polyol (a1) preferably contains a polyester polyol (a3) that can be obtained by reacting an alkylene oxide adduct of bisphenol A with polycarboxylic acid from the viewpoint of forming a surface skin layer having a supple feeling, other than the polytetramethylene glycol. By using the polyester polyol (a3), compatibility between polyols is improved, physical properties of the surface skin layer can be made to be uniform and good, and at the same time, the adhesiveness between the surface skin layer and the substrate layer becomes good.

The content of the polyester polyol (a3) in the polyol (a1) is preferably in the range of 10% by mass to 60% by mass. If the content of the polyester polyol (a3) is in this range, good improvement effects of the physical properties of the surface skin layer and the adhesiveness between the surface skin layer and the substrate layer can be obtained.

Ethylene oxide, propylene oxide, styrene oxide, etc. are preferable as alkylene oxide that can be used in the manufacturing of the polyester polyol (a3) in respect that they give excellent suppleness to the surface skin layer of the leather-like sheet, and propylene oxide is especially preferable.

A combination of aliphatic polycarboxylic acid and aromatic polycarboxylic acid is preferable as polycarboxylic acid that can be used in the manufacturing of the polyester polyol (a3) in respect that the compatibility with other polyols can be improved, and a combination of sebacic acid and isophthalic acid is especially preferable.

Further, as examples of other polyols that can be used with the polytetramethylene glycol, a polyether polyol other than polytetramethylene glycol, a polyesterpolyol other than the polyester polyol (a3), a polycarbonate polyol, an acrylic polyol, a polyolefin polyol, a caster oil polyol, a silicon modified polyol, and mixtures thereof can be used. Among them, the polyester polyol is preferably used with the polytetramethylene glycol from the viewpoint of forming a surface skin layer in which surface tack is suppressed and the fuzz generation is suppressed.

Polyalkylene glycol is preferably used for example as the polyether polyol. As examples of polyalkylene glycol other than polytetramethylene glycol, polypropylene glycol, etc. as well as polymers, etc. in which a ring-opening polymerization is performed on one type or two types or more selected from ethylene oxide, propylene oxide, butylene oxide, styrene oxide, etc. using various low molecular weight polypols as an initiator can be used. Further, polymers in which a ring-opening addition is performed on polyether polyol with γ-butyrolactone, ϵ-caprolactone, etc. can be used.

A polyester polyol that can be obtained by condensing various known low molecular weight polyols and polycarboxylic acid can be used as the polyester polyol. In the present invention, in the case of using the polyester polyol together as a polyol component, mechanical characteristics such as wear resistance, blocking resistance, etc. of the surface skin layer can be improved.

As examples of the low molecular weight polyol, one type or two types or more selected from ethylene glycol, 1,2-propylene glycol, 1,3-propylene glycol, 1,3-butanediol, 1,4-butanediol, 2,2-dimethyl-1,3-propanediol, 1,6-hexanediol, 3-methyl-1,5-pentanediol, 1,8-octanediol, diethylene glycol, triethylene glycol, dipropylene glycol, tripropylene glycol, cyclohaxane-1,4-diol, and cyclohexane-1,4-dimethanol can be used. Further, adducts in which various alkylene oxides are added to bisphenol A can be used.

As examples of the polycarboxylic acid, one type or two types or more selected from succinic acid, maleic acid, adipic acid, glutaric acid, pimelic acid, suberic acid, azelaic acid, sebacic acid, dodecanedicarboxylic acid, phthalic acid, isophthalic acid, terephthalic acid, and hexahydroisophthalic acid can be used. Further, polymers can be used in which the ring-opening polymerization is performed on γ-butyrolactone, ϵ-caprolactone, etc. using a low molecular weight polyol as an initiator.

Particularly, from the viewpoint of forming a surface skin layer in which surface tack is suppressed and the fuzz generation is suppressed, polyester polyol that can be obtained by reacting adipic acid with 1,6-hexanediol is preferably used with the polytetramethylene glycol, etc.

Poly(alkylenecarbonate)diol etc. that can be obtained by a condensation reaction of a low molecular weight polyol with one type or two types or more selected from diarylcarbonate, dialkylcarbonate, alkylenecarbonate, etc. can be used as the polycarbonate polyol. Here, the low molecular weight polyol as described above can be preferably used as the low molecular weight polyol.

Further, as the other polyol, a polyol is preferably used in which a dry ball method softening point that is measured at a temperature increasing speed of 5° C./min using a ring and ball method is in the range of 20° C. to 130° C., and more preferably 40° C. to 100° C. from the viewpoint of giving moderate hot-melt property to the urethane prepolymer (A).

As examples of polyol having the dry ball method softening point in the range of 20° C. to 130° C., polyester polyol that can be obtained by performing polycondensation of a low molecular weight polyol having an even number of carbon atoms among the low molecular weight polyols with polycarboxylic acids having an even number of carbon atoms among the polycarboxylic acid and a polycarbonate polyol that can be obtained with the low molecular weight polyol having an even number of carbon atoms as a starting substance can be used.

Further, as examples of the polyisocyanate (a2), aromatic diisocyanates such as a phenylenediisocyanate, a tolylenediisocyanate, a 4,4'-diphenylmethanediisocyanate, a 2,4'-diphenylmethanediisocyanate, a naphthalenediisocyanate, and a xylenediisocyanate; aliphatic diisocyanates or alicyclic diisocyanates such as a hexamethylenediisocyanate, a lysinediisocyanate, a cyclohexanediisocyanate, an isophoronediisocyanate, a dicyclohexylmethanediisocyanate, and a tetramethylxylylenediisocyanate; and polymeric diphenylmethanediisocyanates such as dimers and trimers of a 4,4'-diphenylmethanediisocyanate can be used. A xylylenediisocyanate can be especially preferably used considering light discoloration resistance and moisture curability of the surface skin layer that is formed.

Further, (meth)acrylate containing a hydroxyl group that is reacted with the urethane prepolymer containing isocyanate groups has 1 or 2 or more hydroxyl groups in its molecule. Among them, (meth)acylate having only one hydroxyl group in its molecule is preferably used from the viewpoint of avoiding the molecular weight of the urethane prepolymer (A) to increase excessively, and acrylate containing a hydroxyl group is more preferably used.

More specifically, 2-hydroxyethyl(meth)acrylate, 2-hydroxypropyl(meth)acrylate, 3-hydroxypropyl(meth)acrylate, 2-hydroxy-3-phenoxypropyl(meth)acrylate, and pentaerythritoltriacylate, for example, are preferably used from the viewpoint of suppressing the surface tack of the surface skin layer and at the same time, improving its mechanical strength and adhesiveness, and 2-hydroxyethylacrylate is especially preferably used because excellent curability is realized by the ultraviolet ray irradiation.

The urethane prepolymer (A) that is used in the present invention can be manufactured with a known and used method, and it can be manufactured with a first step of manufacturing urethane prepolymer containing isocyanate groups and a second step of reacting the urethane prepolymer containing isocyanate groups with the (meth)acrylate containing a hydroxyl group.

The first step is a step of manufacturing urethane prepolymer containing isocyanate groups by adding dropwise polyol (a1) or supplying a bulk polyol (a1) from which moisture is removed into the polyisocyanate (a2) in a reactor, heating, and reacting until the hydroxyl group in the polyol (a1) has been substantially consumed. The manufacturing of the urethane prepolymer containing isocyanate groups can also be performed by charging the polyol (a1) and the polyisocyanate (a2) that are heated in advance into an extruder at a prescribed ratio, and performing a so-called continuous extruding reaction method.

The prepared ratio of the polyol (a1) and the polyisocyanate (a2) is preferably adjusted so that the equivalent ratio of the amount of the isocyanate group that is contained in the polyisocyanate (a2) and the amount of the hydroxyl group that is contained in the polyol (a1) (NCO/OH) is in the range of (NCO/OH)=1.1 to 5.0. The equivalent ratio (NCO/OH) is more preferably 1.5 to 4.0, and especially preferably 2.0 to 4.0. By reacting within this range of (NCO/OH), a polyurethane hot-melt composition can be obtained that is capable of further suppressing the fuzz generation on the surface skin layer.

The manufacturing of the urethane prepolymer containing isocyanate groups can be normally performed with no solvent. However, it may be manufactured in an organic solvent. In the case of manufacturing in an organic solvent, an organic solvent such as ethylacetate, n-butylacetate, methylethylketone, and toluene that does not hinder the reaction of the polyol (a1) with polyisocyanate (a2) can be used. However, in the case of using an organic solvent, it is necessary to remove the organic solvent in the middle of the reaction or after the reaction is completed with a method such as a reduced pressure heating.

When manufacturing the urethane prepolymer containing isocyanate groups, a urethanation catalyst can be used depending on necessity. The urethanation catalyst can be appropriately used in an arbitrary stage in the reaction processes.

As examples of the urethanation catalyst, a nitrogen-containing compound such as triethylamine, triethylenediamine, and N-methylmorpholine; potassium acetate; zinc stearate; tin octylate; di-n-butyltindiacetate; di-n-butyltindilaurate; 1,8-diaza-bicyclo(5,4,0)undecene-7(DBU); DBU-p-toluenesulfonate; DBU-formate; DBU-octylate; DBU-phenolate; an amine-based catalyst; a morpholine based catalyst; bismuth nitrate; tin chloride; iron chloride; and dibutyltindilaurate can be used.

Further, the second step is a step of reacting the urethane prepolymer containing isocyanate groups that is obtained in the first step with (meth)acrylate containing a hydroxyl group.

Specifically, the urethane prepolymer containing isocyanate groups and (meth)acrylate containing a hydroxyl group are mixed in the reactor while heating, and 5% to 50% of the number of isocyanate groups in the urethane prepolymer containing isocyanate groups are reacted with the hydroxyl groups in the (meth)acrylate containing a hydroxyl group. Thereby, a urethane prepolymer (A) that can be used in the present invention can be manufactured.

The content of the isocyanate groups in the urethane prepolymer (A) is preferably in the range of 1% by mass to 5% by mass, and more preferably in the range of 1.5% by mass to 3% by mass of the entire urethane prepolymer (A). If it is a polyurethane hot-melt composition containing the urethane prepolymer (A) having isocyanate groups in such a range, a surface skin layer that has a supple feeling and that is excellent in mechanical strength can be formed.

Next, a coloring agent (B) that is used in the present invention will be described.

The coloring agent (B) is used to give a desired color to the surface skin layer of the leather-like sheet. The content of the coloring agent (B) that is used is in the range of 5 parts by mass to 40 parts by mass, and preferably in the range of 10 parts by mass to 30 parts by mass based on 100 parts by mass of the urethane prepolymer (A). By using the coloring agent (B) in this range, good color can be given to the surface skin layer of the leather-like sheet.

A coloring agent that contains a pigment, a vehicle (a so-called color development agent) to give fluidity, transferring property, drying property, adhesiveness, dry film characteristics to the coloring agent, and known additives depending on necessity can be used for example as the coloring agent (B).

The coloring agent (B) contains at least a polyol as a vehicle. The number average molecular weight of the polyol is preferably in the range of 1000 to 20000. By using a coloring agent that contains the polyol having a number average molecular weight in this range, the work stability when mixing with the urethane prepolymer (A) becomes good, and the pigment can be dispersed uniformly into the polyurethane hot-melt composition. Further, compared with the case of mixing the single pigment into the polyurethane hot-melt composition, the mechanical strength of the surface skin layer that is formed can be improved.

The polyol that is used as a vehicle is not especially limited, and examples that can be used include polyetherpolyols such as a polyesterpolyol and polyalkylene glycol, further, a polycarbonatepolyol, an acrylic polyol, a polyolefinpolyol, a castor oil polyol, urethane modified polyol, and a silicon modified polyol, etc. Typically, the urethane modified polyol can be a polyol containing a urethane bond in which a part of the hydroxyl groups in the polyol is modified by an isocyanate compound.

As the vehicle, polyalkylene glycol and urethane modified polyol are especially preferably used. Among them, polyalkylene glycol that has a number average molecular weight in the range of 1000 to 20000 is more particularly preferable from the viewpoint of obtaining the leather-like sheet having good suppleness and feeling in the temperature used from a low temperature to a normal temperature.

As examples of polyalkylene glycol that can be used as the vehicle, a polyol that can be obtained by performing a ring-opening polymerization on one type or two types or more selected from alkylene oxide such as ethylene oxide, propylene oxide, and butylene oxide, and styrene oxide, etc. using the polyol described above as the low molecular weight polyol as an initiator; and polymers in which a ring-opening addition of γ-butyrolactone, ε-caprolactone, etc. is performed on the polyol can be used, as well as polypropylene glycol and polytetramethylene glycol, etc. From the viewpoint that wettability with the pigment is good and it is capable of giving a good feeling and excellent durability to the leather-like sheet, polypropylene glycol and polytetramethylene glycol are especially preferable.

The coloring agent (B) may contain a pigment, and as examples of such pigment, inorganic pigments such as titanium oxide, zinc oxide, zinc flower, carbon black, ferric oxide (red iron oxide), lead chromate (molybdate orange), chrome yellow, yellow iron oxide, ochre, ultramarine, and cobalt blue, and organic pigments such as an azo-based organic pigment, a naphthol-based organic pigment, a pyrazolone-based organic pigment, an anthraquinone-based organic pigment, a perylene-based organic pigment, a quinacridone-based organic pigment, a disazo-based organic pigment, an isoindolinone-based organic pigment, a benzimidazole-based organic pigment, a phthalocyanine-based organic pigment, and a quinophthalone-based organic pigment can be used. One type or two types or more of the pigments can be combined and used. Further, together with the pigment as described above, extender pigments such as calcium bicarbonate, clay, silica, kaolin, talc, precipitated barium sulfate, barium carbonate, white carbon, and diatomite can be used. A chemical surface treatment may be performed on the surface of the pigment by a silane coupling agent, etc. for example in order to improve the wettability and adhesiveness to the vehicle. Further, when kneading the vehicle and the pigment, additives such as a known pigment dispersion agent and an agent of preventing color separation may be added.

The coloring agent (B) can be manufactured by kneading the vehicle, the pigment and the additive, depending on necessity. When kneading the vehicle, the pigment, etc., from the viewpoint of kneading the vehicle in a heat melt condition and the pigment uniformly, a dispersion machine can be used such as a planetary mixer, a ball mill, a pebble mill, a sand mill, an attritor, a roll mill, a high speed impeller dispersion machine, and a high speed stone mill for example.

The mixing ratio (mass ratio) of the vehicle and the pigment is preferably in the range of (vehicle/pigment)=95/5 to 20/80. If it is in this range, a coloring agent (B) can be obtained in which the work stability is good and the pigment dispersibility is also good without gelling.

Next, multi-functional (meth)acrylate (C) as used in the present invention will be described.

Multi-functional (meth)acrylate (C) is a necessary component of the polyurethane hot-melt composition that is used in the present invention. Because the multi-functional (meth) acrylate (C) contributes to the formation of a cross-linked structure by the double bond in its molecule, the curing speed and the cross-linking density after curing of the polyurethane hot-melt composition are further improved, and as a result, good durability and fuzz resistance can be given to the surface skin layer of the leather-like sheet. Here, the "multifunctional" means to have two or more polymerizable double bonds, and it is preferably 2 to 4.

The content of the multi-functional (meth)acrylate (C) is necessarily in the range of 5 parts by mass to 50 parts by mass, and preferably in the range of 10 parts by mass to 30 parts by mass based on 100 parts by mass of the urethane prepolymer (A). By using the multi-functional (meth)acrylate (C) in this range, the fuzz generation can be suppressed better without spoiling the supple feeling of the surface skin layer of the leather-like sheet.

As examples of the multi-functional (meth)acrylate (C), one type or two types or more selected from (meth)acrylate such as polyethylene glycol di(meth)acrylate, tripropylene glycol di(meth)acrylate, neopentyl glycol hydroxypivalatedi (meth)acrylate, modified (meth)acrylate in which bisphenol A is modified by ethylene oxide or propylene oxide, ditrimethylolpropanetetra(meth)acrylate, neopentyl glycol di(meth)acrylate, 1,6-hexanedioldi(meth)acrylate, trimethylolpropanetri(meth)acrylate, pentaerythritoltri(meth)acrylate, and pentaerythritoltetra(meth)acrylate; and (meth)acrylateester of sugar alcohol such as sorbitol can be used. Further, those in which alkylene oxide, aliphatic ester, caprolactone, etc. is added further into these (meth)acrylates can be used. An ethylene oxide adduct, a propylene oxide adduct, etc. can be used as the alkylene oxide adduct.

As the multi-functional (meth)acrylate (C), from the viewpoint of giving excellent curability by the ultraviolet ray irradiation, one type or two types or more selected from trimethylolpropanetriacrylate, pentaerythritoltriacrylate, and an ethylene oxide adduct and a propylene oxide adduct of them is preferably used.

Next, a photopolymerization initiator (D) that is used in the present invention will be described.

The photopolymerization initiator (D) acts as an initiator of the cross-linking reaction of the polymerizable unsaturated double bond in the urethane prepolymer (A).

The content of the photopolymerization initiator (D) is necessarily in the range of 0.5 parts by mass to 5 parts by mass, and preferably in the range of 1 part by mass to 3 parts by mass based on 100 parts by mass of the urethane prepolymer (A). By using the photopolymerization initiator (D) in this range, the curing speed of the polyurethane hot-melt composition that forms the surface skin layer can be suitably adjusted, and as a result, the fuzz generation can be suppressed even better, and at the same time, the cross-linking reaction can proceed uniformly.

As an example of the photopolymerization initiator (D), a conventionally known photopolymerization initiator such as an alkylphenone-based photopolymerization initiator such as benzophenone, and a camphorquinone-based photopolymerization initiator, an acylphosphine oxide-based photopolymerization initiator, and a titanocene-based photopolymerization initiator can be preferably used.

As examples of the commercially available product, Quantacure (manufactured by International Bio-Synthetics, Ltd.), Kayacure MBP (manufactured by Nippon Kayaku Co., Ltd.), Esacure BO (manufactured by Fratelli Lamberti), Trigonal 14 (manufactured by Kayaku Akzo Co., Ltd.), Irgacure (trademark), Darocure (trademark), Speedcure (trademark) (the above three manufactured by Nihon Ciba-Geigy K.K.), and a mixture of Darocure (trademark) 1173 and Fi-4 (manufactured by Eastman Chemical Company) can be used. Among them, Irgacure 819 that can give excellent curability due to the ultraviolet irradiation can be preferably used.

Other than the various components, additives such as a urethanation catalyst, a silane coupling agent, a filler, a thixotropy imparting agent, a tackifier, a wax, a thermal stabilizer, a light stabilizer, a fluorescent brightening agent, a foaming agent, and a thermoplastic resin, a thermosetting resin, a dye, a conductivity-imparting agent, an antistatic agent, a moisture-permeability improving agent, a water repelling agent, an oil repelling agent, a hollow foam, a compound containing crystal water, a flame retardant, a water absorber, a moisture absorber, a deodorant, a foam stabilizer, a foam extinguisher, a mildew proofing agent, a preservative, an algicide, a pigment dispersing agent, an inert gas, a blocking preventing agent, and a hydrolysis preventing agent can be used together for example in the polyurethane hot-melt composition that is used in the present invention depending on necessity. Further, an organic water-soluble compound and/or an inorganic water-soluble compound can be used in the polyurethane hot-melt composition in order to promote the moisture curing by improving the water absorbency.

As examples of the urethanation catalyst, one type or two types or more selected from urethanation catalysts such as stannous octylate, di-n-butyltindiacetate, di-n-butyltindilaurate, 1,8-diaza-bicyclo(5,4,0)undecene-7(DBU), DBU-p-toluenesulfonate, DBU-formate, DBU-octylate, DBU-phenolate, an amine-based catalyst, a morpholine-based catalyst, bismuth nitrate, tin chloride, and iron chloride can be used.

As examples of the silane coupling agent, γ-glycidoxypropyltrimethoxysilane, α-glycidoxypropylmethyldiethoxysilane, β-(3,4-epoxycyclohexyl)ethyltrimethoxysilane, γ-methacryloxypropyltrimethoxysilane, γ-mercaptopropyltrimethoxysilane, vinyltrimethoxysilane, and γ-chloropropyltrimethoxysilane, etc. can be used.

As examples of the filler, calcium carbonate, aluminum hydroxide, barium sulfate, kaolin, talc, carbon black, alumina, magnesium oxide, inorganic balloons, organic balloons, lithia tourmaline, and activated carbon, etc. can be used.

As examples of the thixotropy imparting agent, surface processed calcium carbonate, fine powder silica, bentonite, and zeolite, etc. can be used.

Next, a manufacturing method of the polyurethane hot-melt composition that is used in the present invention will be described.

The method for manufacturing the polyurethane hot-melt composition is not especially limited. However, an example is a method of mixing the urethane prepolymer (A) that is manufactured in advance with the above-mentioned method, the coloring agent (B), the multi-functional (meth)acrylate (C), and the photopolymerization initiator (D) at a prescribed ratio.

Specifically, an example is a method of mixing the urethane prepolymer (A) and the coloring agent (B) in a hot-melt condition, and then further mixing the mixture thereof with the multi-functional (meth)acrylate (C) and the photopolymerization initiator (D).

An example of the mixing method includes a method of using a batch type stirrer, a static mixing machine such as a static mixer, and mixing apparatus such as a rotor/stator type. Among them, a method of using a two-liquid continuous mixing apparatus having a structure where the urethane prepolymer (A), etc. can be maintained in the hot-melt condition is preferable.

The setting temperature of the apparatus that is used for stirring and mixing such as the two-liquid continuous mixing apparatus may be appropriately set considering, for example, the desired quality and productivity of the polyurethane hot-melt composition, and it is normally preferably kept in the range of the melt temperature of the urethane prepolymer (A) or more to a melt temperature +30° C. or less. In the case where the setting temperature of the apparatus is in this range, the stirring and mixing can be performed uniformly, and the workability is excellent. Further, in the case where the setting temperature is in this range, it is also preferable in respect that problems such as discoloration of the coloring agent (B) due to the thermal history are suppressed.

Here, air bubbles that are generated in the apparatus when manufacturing the polyurethane hot-melt composition by stirring and mixing are preferably appropriately removed by a de-bubbling process using a reduced pressure pump, etc.

When hot-melting the urethane prepolymer (A), it is preferably melted by heating at a temperature in the range of 50° C. to 130° C. considering an increase of the viscosity due to the thermal history. Further, the coloring agent (B) is preferably subjected to the stirring and mixing in a liquid form (that is, a fluid state) by maintaining or heating in a temperature range of normal temperature (specifically 23° C.) to 100° C. In this case, a high speed stirring and mixing is preferably performed in order to obtain a uniform polyurethane hot-melt composition.

Further, an example of the method of manufacturing the polyurethane hot-melt composition is a method of performing the manufacturing of the urethane prepolymer (A) and mixing of the coloring agent (B) at the same time and then mixing the mixture thereof with the multi-functional (meth) acrylate (C) and the photopolymerization initiator (D).

Specifically, it is a method of using a material where the coloring agent (B) is mixed into one of or both of the polyol (a1) and the polyisocyanate (a2) in advance as a raw material when manufacturing the urethane prepolymer containing isocyanate groups for using in manufacturing of the urethane polymer (A).

Next, a substrate layer that constitutes the leather-like sheet in the present invention will be described.

A fiber substrate is typically used as a substrate configuring the substrate layer. An example of the fiber substrate is a substrate composed of non-woven fabric, woven fabric, knitted fabric, natural leather, etc. Further, a substrate can be used that is made by immersing one type or more of resins such as a polyurethane resin, an acrylic resin, and a butadiene based resin (SBR, NBR, MBR) that is any of solvent-based, water-based, emulsion-based, and non-solvent-based in the non-woven fabric, woven fabric, knitted fabric, etc. Among them, a substrate that is made of very fine fiber non-woven fabric in which a polyurethane resin is immersed is preferable in respect that a leather-like sheet having a more supple feeling and excellent durability can be obtained.

The substrate layer may be one layer or two layers or more. A plurality of the substrate layers that are adhered by performing an entire surface adhesion or an adhesion treatment by application of a dot adhesive using an adhesive selected from a solvent-based, a water-based, an emulsion-based, a non-solvent-based, and a hot-melt-based adhesive for example can be used as the substrate layer that is made of two layers or more.

As described above, the leather-like sheet of the present invention may have an intermediate layer between the substrate layer and the surface skin layer in order to give a supple feeling, etc.

As examples of a material for the intermediate layer, a polyurethane resin, an acrylic resin, and a butadiene-based resin (SBR, NBR, MBR), etc. can be preferably used.

The intermediate layer is preferably a porous layer, and in this case, the suppleness and feeling of the leather-like sheet can be further improved. As examples of a preferred material for the porous layer, a polyurethane resin, an acrylic resin, and a butadiene-based resin (SBR, NBR, MBR), etc. can be used, and among them, a polyurethane resin can be preferably used in respect that the adhesiveness with the polyurethane hot-melt composition that forms the surface skin layer is good and from the viewpoint that good suppleness can be given to the leather-like sheet.

A preferred combination of the intermediate layer and the substrate layer is a combination of the substrate layer composed of a very fine fiber non-woven fabric in which a polyurethane resin is immersed and a porous layer composed of a polyurethane resin.

Next, a manufacturing method of the leather-like sheet in the present invention will be described.

The leather-like sheet in the present invention is made by a surface skin layer laminating directly onto a substrate layer or interposing an intermediate layer therebetween as described above. However, a manufacturing method of the leather-like sheet in which the surface skin layer is directly laminated onto the substrate layer is specifically described.

The following method is a first method of manufacturing the leather-like sheet.

Figure 3:
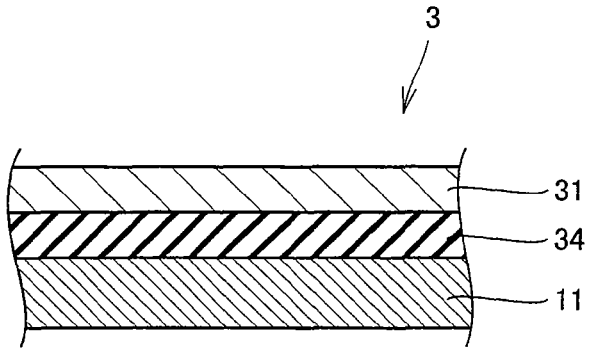
FIG. 3 is a cross-sectional view showing a laminated body that is produced in the manufacturing process of the leather-like sheet according to the present invention.

For example, first, a laminated body as shown in FIG. 3 for example is formed by applying a polyurethane hot-melt composition that is hot-melted preferably in the range of 50° C. to 130° C. and more preferably in the range of 80° C. to 130° C. onto a releasable substrate uniformly in a sheet form using a coating apparatus, placing and pasting a substrate on its coated surface, and solidifying the polyurethane hot-melt composition by cooling it at normal temperature. FIG. 3 is a cross-sectional view showing the laminated body that is produced in the manufacturing process of the leather-like sheet in the present invention. In a laminated body 3 shown in FIG. 3, a polyurethane hot-melt composition 34 and a releasable substrate 31 are formed on substrate layer 11.

After that, the releasable substrate is peeled and removed from the laminated body, and the polymerizable unsaturated double bond in the urethane prepolymer is subjected to a radical reaction by ultraviolet ray radiation etc., and the curing is further conducted.

After that, the polyurethane hot-melt composition is cured by winding the laminated body up into a roll for example, and maturing for a fixed period of time. With the method as above, the leather-like sheet in the present invention can be manufactured in which a surface skin layer is laminated on a substrate layer.

Further, the following method is a second method of manufacturing the leather-like sheet.

For example, first, the polyurethane hot-melt composition is solidified by applying the polyurethane hot-melt composition that is heat-melted in the same way as described above onto a substrate, placing and pasting a releasable substrate on its coated surface, and cooling it at normal temperature.

After that, the releasable substrate is peeled and removed from the laminated body, and the polymerizable unsaturated double bond in the urethane prepolymer is subjected to a radical reaction by ultraviolet ray radiation etc., and the curing is further conducted.

After that, the polyurethane hot-melt composition is cured by winding the laminated body up into a roll for example, and maturing for a fixed period of time. With the method as above, the leather-like sheet in the present invention can also be manufactured in which a surface skin layer is laminated on a substrate layer.

Here, a coater that is capable of controlling the temperature approximately in the range of 60° C. to 170° C. can be preferably used as an apparatus that applies the polyurethane hot-melt composition that is hot-melted onto the substrate, and preferred examples are a roll coater, a spray coater, a T-die coater, a knife coater, a comma coater, etc., and among them, a method of using a roll coater is preferable in respect that it controls the thickness of the surface skin layer with a better accuracy.

Further, the ultraviolet ray irradiation when manufacturing the leather-like sheet is preferably performed at an irradiation rate of 1 to 10 Mrad from the viewpoint of sufficiently promoting the curing and suppressing damage of the substrate layer, etc. due to the ultraviolet ray, and more preferably 2 to 5 Mrad.

Further, as a condition of maturing when manufacturing the leather-like sheet, the general condition is that the ambient temperature is 20° C. to 40° C., the relative humidity is 50% to 80%, the maturing time is 1 to 5 days, and more typically 3 days. The maturing is generally performed in a condition that the leather-like sheet is wound by a roll, etc. as described above. By adopting such maturing condition, a reaction is completed between the isocyanate groups that remain in the polyurethane hot-melt composition and moisture (that is, water), and a leather-like sheet can be obtained in which the fuzz generation of the surface skin layer is suppressed and durability is excellent.

When the surface skin layer is formed by moisture-curing the polyurethane hot-melt composition that is conventionally known, in the case where the curing of the polyurethane hot-melt composition is not completed even after the maturing is performed for example or in the case of the composition in which tackiness is easily generated even it is cured completely, there is often the case where tackiness remains on the surface of the surface skin layer. On the other hand, because the curing of the polyurethane hot-melt composition is sufficiently conducted in the present invention by a gradual cross-linking reaction due to the contribution of the double bond, a surface skin layer is formed in which the tackiness is remarkably decreased and the fuzz generation is suppressed.

As the releasable substrate that can be used when manufacturing the leather-like sheet in the present invention, any substrate can be used as long as it is a substrate that is made of a material having a releasability from the polyurethane hot-melt composition, or a substrate on which at least a releasing treatment or a water repelling treatment is performed on the contact surface with the polyurethane hot-melt composition. In the case of using a substrate on which the releasing treatment is performed, the material of the substrate itself is not especially limited. As the releasing treatment, there is a method of forming a layer composed of a substance with a small surface energy on the surface of the substrate, etc.

As specific examples of the releasable substrate, a releasable paper, a releasing treated fabric (that is, a fabric on which the releasing treatment is performed), a water-repelling treated fabric, an olefin sheet or an olefin film composed of a polyethylene resin, a polypropylene resin, etc., a sheet or a film composed of a fluorine resin, and a plastic film with a releasable paper, etc. can be used.

As an example of the plastic film with a releasable paper, a polyurethane resin film with a releasable paper can be used. As the polyurethane resin, a polyurethane resin such as a solvent-based, a water-based, an emulsion-based, and a non-solvent-based resin can be used.

Further, in the case of forming an uneven pattern on the surface skin layer in order to give a surface design to the leather-like sheet, a releasable substrate is preferably used having an uneven pattern corresponding to the uneven pattern that is desired to be formed.

Further, the uneven pattern may be formed on the surface skin layer by performing an embossing treatment, especially a thermal embossing treatment on the surface skin layer of the leather-like sheet directly or interposing a releasable substrate therebetween using an emboss roll having the uneven pattern.

The surface skin layer of the leather-like sheet in the present invention preferably has a thickness in the range of 30 μm to 800 μm, and more preferably 50 μm to 500 μm. The leather-like sheet having a surface skin layer of the thickness of this range is excellent in surface grade because an uneven shape of the surface of the substrate layer can be prevented from appearing on the surface of the leather-like sheet without spoiling the supple feeling, etc.

In the present invention, the 100% modulus of the surface skin layer is preferably in the range of 1.0 MPa to 8.0 MPa, and more preferably 2.0 MPa to 6.0 MPa. Such a surface skin layer has good mechanical strength, excellent durability, suppleness, and feeling. Here, the 100% modulus is a value for which a film of 150 μm thickness composed of the polyurethane hot-melt composition is left at a temperature of 23° C. and a relative humidity of 65% for one day, and then is measured with a method of JIS K6772 immediately after the ultraviolet ray irradiation is performed.

Further, in the leather-like sheet in the present invention, in order to give the surface design, a polyurethane resin and an acrylic resin selected from a solvent-based, a water-based, an emulsion-based, and a non-solvent-based resin can be applied onto the surface of the surface skin layer for example, and a post process such as a buffering process can be appropriately performed.

EXAMPLES

Below, the present invention will be described in more detail with respect to examples.

(Measurement Method of Number Average Molecular Weight (Mn))

The number average molecular weight (Mn) was calculated in terms of polystyrene by measuring with a gel filtration chromatography (GPC) method.

(Measurement Method of Melt Viscosity)

The melt viscosity (mPa·s) of a urethane prepolymer was measured using a cone plate viscometer (manufactured by Imperial Chemical Industries Limited, measurement temperature of 125° C.).

(Measurement Method of Glass Transition Temperature (Tg))

The glass transition temperature (Tg) of the urethane prepolymer was determined based on the peak temperature (unit: ° C.) of loss tangent (tan δ) that is obtained by measuring a film that is obtained by applying the urethane prepolymer at a thickness of 150 μm and maturing for 5 days in an environment of the ambient temperature of 23° C. and relative humidity of 65% using a dynamic viscoelasticity measuring machine (manufactured by TA Instruments, Japan, frequency of 1 Hz, rising temperature speed of 5° C./min).

(100% Modulus, Stress at Break, Elongation at Break)

The 100% modulus, the stress at break, and the elongation at break of a film of 5 mm wide×7 cm long×150 μm thick that was obtained using the polyurethane hot-melt composition were measured using Tensilon (manufactured by Shimadzu Corporation, head speed: 300 min/min) according to JIS K7311.

(Surface Tackiness (Fuzz Property))

The polyurethane hot-melt composition was applied onto a release paper (DE-123, manufactured by Dai Nippon Printing Co., Ltd.) so that the film thickness would become 150 μm, a non-woven fabric in which urethane was immersed was pasted on the coated surface, and it was matured for 1 day, 2 days, and 3 days each in an environment of temperature of 23° C. and relative humidity of 65%.

After the maturing, ultraviolet (UV) ray irradiation was performed onto a laminated body that was obtained by peeling and removing the release paper. The ultraviolet ray irradiation was performed by passing the laminated body once in a conveyor type ultraviolet ray irradiation apparatus "CSOT-40" (manufactured by GS Yuasa Corporation, using a high pressure mercury lamp, intensity of 120 W/cm, conveyor speed of 10 m/min) that was set so that an ultraviolet ray of 145 mJ/cm$^2$ was radiated every time the laminated body passed once in the apparatus, and a leather-like sheet was produced.

The surfaces of two laminated bodies before the ultraviolet ray irradiation were contacted with each other with an area of 10 cm×10 cm, and were pressed for 1 hour with a load of 1 kg/100 cm$^2$. Further, the surfaces of two leather-like sheets after the ultraviolet ray irradiation were contacted with each other with an area of 10 cm×10 cm, and were pressed for 1 hour with a load of 1 kg/100 cm$^2$.

The surface tack of the surface skin layer of each laminated body and leather-like sheet after being pressed was evaluated with the following standard.

Evaluation Standard

A: There was no surface tack on the surface skin layer.

B: There was a little surface tack only on a part of the surface skin layer.

C: Tack and stringing were seen on the surface of the surface skin layer.

D: The contact between the surface skin layers of the leather-like sheet or the laminated body could not be undone, and cohesive failure occurred on the surface skin layer after pressurizing.

(Low Temperature Bending Property)

The laminated body in which the polyurethane hot-melt composition was applied onto a release paper (DE-123, manufactured by Dai Nippon Printing Co., Ltd.) so that the film thickness would become 150 μm and a non-woven fabric in which urethane was immersed was pasted on the coated surface and the resultant was matured for 3 days in an environment of temperature of 23° C. and relative humidity of 65%, and the leather-like sheet that was obtained by performing ultraviolet irradiation with the same test method as the "Surface Tackiness" on its surface were bent 100000 times at low temperature (−10° C.) using a flexometer (manufactured by Toyo Seiki Seisaku-sho, Ltd.), and then the appearance was evaluated with the following standard.

Evaluation Standard

A: Extremely good.

B: Good.

C: The surface was broken a little.

D: The surface was broken.

Manufacturing of Urethane Prepolymer (A)

Synthesis Example 1

An alkylene oxide adduct of bisphenol A that was obtained by adding 6 mol of propylene oxide into 1 mol of bisphenol A was reacted with sebacic acid and isophthalic acid, and a polyester polyol (I) having a number average molecular weight of 2000 was obtained.

50 parts by mass of polytetramethylene glycol having a number average molecular weight of 2000 and 50 parts by mass of the polyester polyol (I) that was synthesized above were heated to 120° C. at a reduced pressure in a four-neck flask having a capacity of 1 liter, and it was dehydrated until the moisture ratio became 0.05% by mass.

Then, 20 parts by mass of 4,4'-diphenylmethanediisocyanate was added into a mixture of the polytetramethylene glycol and the polyester polyol (I) that was cooled to 60° C., 0.01 parts by mass of di-n-butyltindilaurate was further added thereto as a catalyst, and then the temperature was increased to 110° C., the reaction was performed for 5 hours until the content of the isocyanate groups became a constant, and a urethane prepolymer (1) containing isocyanate groups was obtained. The melt viscosity of the urethane prepolymer (1) at 125° C. was 3000 mPas, the content of the isocyanate groups was 3.8% by mass, and the glass transition temperature (Tg) was −23° C.

Synthesis Example 2

A urethane prepolymer (2) was obtained by adding 0.68 parts by mass of 2-hydroxyethylacrylate and 0.01 parts by mass of tin octylate into 100 parts by mass of the urethane prepolymer (1) that was heated to 110° C. The ratio of the number of the isocyanate groups with which the hydroxyl groups of 2-hydroxyethylacrylate were reacted based on the entire number of the isocyanate groups in the urethane prepolymer (1) ((HEA/NCO)×100) was 10%.

Here, ((HEA/NCO)×100) of the urethane prepolymer (2) was obtained by the following method. Excessive dibutylamine was added into urethane prepolymer (2), and the isocyanate groups that remained in urethane prepolymer (2) were reacted with dibutylamine. Then, the amount of the isocyanate groups in the urethane prepolymer was calculated by obtaining the amount of the remaining dibutylamine with a back titration method using hydrochloric acid, and ((HEA/NCO)×100) of the urethane prepolymer (2) was calculated. The ((HEA/NCO)×100) of urethane prepolymers (3) to (12) shown below were obtained with the same method.

Synthesis Example 3

A urethane prepolymer (3) was obtained with the same method as in Synthesis Example 2 except that the amount of 2-hydroxyethylacrylate used was changed to 1.36 parts by mass. The ((HEA/NCO)×100) of the urethane prepolymers (3) was 20%.

Synthesis Example 4

A urethane prepolymer (4) was obtained with the same method as in Synthesis Example 2 except that the amount of 2-hydroxyethylacrylate used was changed to 3.06 parts by mass. The ((HEA/NCO)×100) of the urethane prepolymers (4) was 45%.

Synthesis Example 5

A urethane prepolymer (5) was obtained with the same method as in Synthesis Example 2 except that the amount of 2-hydroxyethylacrylate used was changed to 7.13 parts by mass. The ((HEA/NCO)×100) of the urethane prepolymers (5) was 100%, and a part of non-reacted 2-hydroxyethylacrylate remained.

Synthesis Example 6

Adipic acid and 1,6-hexanediol were reacted, and a polyester polyol (II) having a number average molecular weight of 2000 was obtained.

60 parts by mass of polytetramethylene glycol having a number average molecular weight of 2000 and 40 parts by mass of the polyester polyol (II) that was synthesized above were heated to 120° C. at a reduced pressure in a four-neck flask having a capacity of 1 liter, and it was dehydrated until the moisture ratio became 0.05% by mass.

Then, 20 parts by mass of 4,4'-diphenylmethanediisocyanate was added into a mixture of the polytetramethylene glycol and the polyester polyol (II) that was cooled to 60° C., 0.01 parts by mass of di-n-butyltindilaurate was further added thereto as a catalyst, and then the temperature was increased to 110° C., the reaction was performed for 2 hours until the content of the isocyanate groups became a constant, and a urethane prepolymer (6) containing isocyanate groups was obtained. The melt viscosity of the urethane prepolymer (6) at 125° C. was 2800 mPas, the content of the isocyanate groups was 3.8% by mass, and the glass transition temperature (Tg) was 45° C.

Synthesis Example 7

A urethane prepolymer (7) was obtained by adding 0.68 parts by mass of 2-hydroxyethylacrylate and 0.01 parts by mass of tin octylate into 100 parts by mass of the urethane prepolymer (6) that was heated to 110° C. The ratio of the number of the isocyanate groups with which the hydroxyl groups of 2-hydroxyethylacrylate were reacted based on the entire number of the isocyanate groups in the urethane prepolymer (6) ((HEA/NCO)×100) was 10%.

Synthesis Example 8

A urethane prepolymer (8) was obtained with the same method as in Synthesis Example 7 except that the amount of 2-hydroxyethylacrylate used was changed to 1.36 parts by mass. The ((HEA/NCO)×100) of the urethane prepolymers (8) was 20%.

Synthesis Example 9

A urethane prepolymer (9) was obtained with the same method as in Synthesis Example 7 except that the amount of 2-hydroxyethylacrylate used was changed to 3.06 parts by mass. The ((HEA/NCO)×100) of the urethane prepolymers (9) was 45%.

Synthesis Example 10

A urethane prepolymer (10) was obtained with the same method as in Synthesis Example 7 except that the amount of 2-hydroxyethylacrylate used was changed to 7.13 parts by mass. The ((HEA/NCO)×100) of the urethane prepolymers (10) was 100%, and a part of non-reacted 2-hydroxyethylacrylate remained.

Synthesis Example 11

100 parts by mass of polytetramethylene glycol having a number average molecular weight of 2000 was heated to 120° C. at a reduced pressure in a four-neck flask having a capacity of 1 liter, and it was dehydrated until the moisture ratio became 0.05% by mass.

Then, 20 parts by mass of 4,4'-diphenylmethanediisocyanate was added into the polytetramethylene glycol that was cooled to 60° C., 0.01 parts by mass of di-n-butyltindilaurate was further added thereto as a catalyst, and then the temperature was increased to 110° C., the reaction was performed for 5 hours until the content of the isocyanate groups became a constant, and a urethane prepolymer containing an isocyanate group (melt viscosity at 125° C.: 3000 mPas, content of isocyanate groups: 3.8% by mass, glass transition temperature: −23° C.) was obtained. A urethane prepolymer (11) was obtained by heating the urethane prepolymer containing an isocyanate group to 110° C., adding 1.36 parts by mass of 2-hydroxyethylacrylate and 0.01 parts by mass of tin octylate thereto, and reacting. The ratio of the number of the isocyanate groups with which the hydroxyl groups of 2-hydroxyethylacrylate were reacted based on the entire number of the isocyanate groups in the urethane prepolymer (11) ((HEA/NCO)×100) was 20%.

Synthesis Example 12

A urethane prepolymer (12) was obtained with the same method as in Synthesis Example 3 except that 15 parts by mass of xylylenediisocyanate was used instead of 4,4'-diphenylmethanediisocyanate. The ((HEA/NCO)×100) of the urethane prepolymer (12) was 20%.

Synthesis Example 13

20 parts by mass of polytetramethylene glycol having a number average molecular weight of 2000 and 80 parts by mass of the polyester polyol (I) were heated to 120° C. at a reduced pressure in a four-neck flask having a capacity of 1 liter, and it was dehydrated until the moisture ratio became 0.05% by mass.

Then, 20 parts by mass of 4,4'-diphenylmethanediisocyanate was added into a mixture of the polytetramethylene glycol and the polyester polyol (I) that was cooled to 60° C., 0.01 parts by mass of di-n-butyltindilaurate was further added thereto as a catalyst, and then the temperature was increased to 110° C., the reaction was performed for 5 hours until the content of the isocyanate groups became a constant, and a urethane prepolymer containing an isocyanate group (melt viscosity at 125° C.: 3000 mPas, content of isocyanate groups: 3.8% by mass, glass transition temperature: −23° C.) was obtained.

Then, a urethane prepolymer (13) was obtained by adding 1.36 parts by mass of 2-hydroxyethylacrylate and 0.01 parts by mass of tin octylate into the urethane prepolymer containing an isocynate group that was heated to 110° C. and reacting. The ratio of the number of the isocyanate groups with which the hydroxyl groups of 2-hydroxyethylacrylate were reacted based on the entire number of the isocyanate groups in the urethane prepolymer (13) ((HEA/NCO)×100) was 20%.

Synthesis Example 14

A urethane prepolymer containing isocyanate groups was synthesized by adding 15.8 parts by mass of isophoronediisocyanate into 100 parts by mass of a polyester polyol (III) having a number average molecular weight of 2600 that was obtained by dehydrating and condensing 1,6-hexanediol, isophthalic acid, and adipic acid at 230° C. at a reduced pressure level 20 mmHg for 14 hours, and reacting at 115° C. for 6 hours until the content of the isocyanate groups became a constant.

A urethane prepolymer (14) was obtained by adding 1.47 parts by mass of 2-hydroxyethylacrylate into 100 parts by mass of the urethane prepolymer containing isocyanate groups and reacting. The ratio of the number of the isocyanate groups with which the hydroxyl groups of 2-hydroxyethylacrylate were reacted based on the entire number of the isocyanate groups in urethane prepolymer (14) ((HEA/NCO)×100) was 20%.

Synthesis Example 15

Manufacturing of Coloring Agent (X)

A coloring agent (X) was obtained by mixing polypropylene glycol having three hydroxyl groups (number average molecular weight of 2000, below, abbreviated as "3-functional PPG") and titanium oxide so as to have a mass ratio of (3-functional PPG/titanium oxide)=60/40, and stirring.

Synthesis Example 16

Manufacturing of Coloring Agent (Y)

A coloring agent (Y) was obtained by mixing urethane modified propylene glycol (below, abbreviated as "urethane modified PPG") that was obtained by adding xylylenediisocyanate to 15% by mass of all hydroxyl groups of a compound (number average molecular weight of 3000) having three or more hydroxyl groups in which polyprolynene glycol was added to glycerin and forming a urethane bond and titanium oxide so as to have a mass ratio of (urethane modified PPG/titanium oxide)=60/40, and stirring.

Manufacturing of Leather-Like Sheet

Example 1

A polyurethane hot-melt composition was manufactured by mixing the coloring agent (X), trimethylolpropanetriacrylate, "IRGACURE 819", and "IRAGACURE 651" (the above two are photopolymerization initiators manufactured by Ciba Specialty Chemicals K.K.) into the urethane prepolymer (2) that was hot-melted at 120° C.

Then, the polyurethane hot-melt composition was applied onto a release paper (DE-123 (a pore pattern) manufactured by Dai Nippon Printing Co., Ltd.) in a sheet form so that the film thickness became 150 μm using a roll coater that was set to 120° C., a non-woven fabric in which urethane was immersed was pasted on the coated surface that was in a tacky condition, it was cooled at normal temperature, then the release paper was peeled and removed, and a laminated body was obtained.

After that, the laminated body was further left to mature for each of period of 1 day, 2 days, and 3 days in an environment of temperature of 23° C. and relative humidity of 65%.

Ultraviolet ray irradiation was performed by passing the laminated body after being matured for each period once in a conveyor type ultraviolet ray irradiation apparatus "CSOT-40" (manufactured by GS Yuasa Corporation, using a high pressure mercury lamp, intensity of 120 W/cm, conveyor speed of 10 m/min) that was set so that an ultraviolet ray of 145 mJ/cm$^2$ was radiated on the surface skin layer of the laminated body every time the laminated body passed once in the apparatus, and a leather-like sheet having a white surface skin layer with a pore pattern was obtained. Here, the non-woven fabric in which urethane was immersed was an interlaced non-woven fabric composed of ultra fine fibers having single fiber fineness of 0.1 dtex into which polyurethane was immersed and coagulated, and having a thickness of 1.3 mm.

Examples 2 to 16, Comparative Examples 1 to 22

A polyurethane hot-melt composition was manufactured with the same method as in Example 1 except the compounding composition was changed to a composition described in Tables 1 to 5 below. Then, a leather-like sheet was manufactured with the same method as in Example 1 except the polyurethane hot-melt composition that was obtained was used in the formation of the surface skin layer of the leather-like sheet.

TABLE 1

| | EXAMPLE 1 | EXAMPLE 2 | EXAMPLE 3 | EXAMPLE 4 | EXAMPLE 5 |
|---|---|---|---|---|---|
| TYPE OF URETHANE PREPOLYMER | (2) | (2) | (3) | (3) | (4) |
| (HEA/NCO) × 100 (%) | 10 | 10 | 20 | 20 | 45 |
| AMOUNT USED (PARTS BY MASS) | 100 | 100 | 100 | 100 | 100 |
| TYPE OF COLORING AGENT | (X) | (X) | (X) | (X) | (X) |
| AMOUNT USED (PARTS BY MASS) | 16.6 | 16.6 | 16.4 | 16.4 | 16.2 |
| TMPTA (PARTS BY MASS) | 8.3 | 16.6 | 8.2 | 16.4 | 8.1 |
| IRGACURE 819 (PARTS BY MASS) | 0.83 | 0.83 | 0.82 | 0.82 | 0.81 |
| IRGACURE 651 (PARTS BY MASS) | 0.83 | 0.83 | 0.82 | 0.82 | 0.81 |
| 100% MODULUS (MPa) | 3.3 | 5.3 | 3.0 | 5.3 | 2.9 |
| STRESS AT BREAK (MPa) | 19.5 | 17.0 | 13.6 | 16.0 | 9.8 |
| ELONGATION AT BREAK (%) | 557 | 335 | 487 | 306 | 270 |
| SURFACE TACKINESS BEFORE ULTRAVIOLET RAY IRRDAIATION | D | D | C | D | D |
| SURFACE TACKINESS AFTER ULTRAVIOLET RAY IRRADIATION AFTER 3-DAY MATURING | B | B | B | B | B |
| LOW TEMPERATURE BENDING PROPERTY BEFORE ULTRAVIOLET RAY IRRADIATION | A | A | A | A | A |
| LOW TEMPERATURE BENDING PROPERTY AFTER ULTRAVIOLET RAY IRRADIATION AFTER 3-DAY MATURING | A | A | A | A | A |

| | EXAMPLE 6 | EXAMPLE 7 | EXAMPLE 8 | EXAMPLE 9 |
|---|---|---|---|---|
| TYPE OF URETHANE PREPOLYMER | (4) | (7) | (7) | (8) |
| (HEA/NCO) × 100 (%) | 45 | 10 | 10 | 20 |
| AMOUNT USED (PARTS BY MASS) | 100 | 100 | 100 | 100 |
| TYPE OF COLORING AGENT | (X) | (X) | (X) | (X) |
| AMOUNT USED (PARTS BY MASS) | 16.2 | 16.7 | 16.7 | 16.6 |
| TMPTA (PARTS BY MASS) | 16.2 | 8.3 | 16.7 | 8.3 |
| IRGACURE 819 (PARTS BY MASS) | 0.81 | 0.83 | 0.83 | 0.83 |
| IRGACURE 651 (PARTS BY MASS) | 0.81 | 0.83 | 0.83 | 0.83 |
| 100% MODULUS (MPa) | 6.0 | 5.5 | 6.5 | 6 |
| STRESS AT BREAK (MPa) | 13.0 | 22.0 | 20.0 | 11.0 |
| ELONGATION AT BREAK (%) | 197 | 500 | 384 | 560 |
| SURFACE TACKINESS BEFORE ULTRAVIOLET RAY IRRDAIATION | D | C | C | C |
| SURFACE TACKINESS AFTER ULTRAVIOLET RAY IRRADIATION AFTER 3-DAY MATURING | B | A | A | A |
| LOW TEMPERATURE BENDING PROPERTY BEFORE ULTRAVIOLET RAY IRRADIATION | A | A | A | A |
| LOW TEMPERATURE BENDING PROPERTY AFTER ULTRAVIOLET RAY IRRADIATION AFTER 3-DAY MATURING | A | A | A | A |

TABLE 2

| | EXAMPLE 10 | EXAMPLE 11 | EXAMPLE 12 | EXAMPLE 13 | EXAMPLE 14 | EXAMPLE 15 | EXAMPLE 16 |
|---|---|---|---|---|---|---|---|
| TYPE OF URETHANE PREPOLYMER | (8) | (9) | (9) | (11) | (11) | (12) | (3) |
| (HEA/NCO) × 100 (%) | 20 | 45 | 45 | 20 | 20 | 20 | 10 |
| AMOUNT USED (PARTS BY MASS) | 100 | 100 | 100 | 100 | 100 | 100 | 100 |
| TYPE OF COLORING AGENT | (X) | (X) | (X) | (X) | (X) | (X) | (Y) |
| AMOUNT USED (PARTS BY MASS) | 16.6 | 16.6 | 16.6 | 16.6 | 16.6 | 17.4 | 16.7 |
| TMPTA (PARTS BY MASS) | 16.6 | 8.3 | 16.6 | 8.3 | 16.6 | 8.7 | 8.3 |
| IRGACURE 819 (PARTS BY MASS) | 0.83 | 0.83 | 0.83 | 0.83 | 0.83 | 0.87 | 0.83 |
| IRGACURE 651 (PARTS BY MASS) | 0.83 | 0.83 | 0.83 | 0.83 | 0.83 | 0.87 | 0.83 |
| 100% MODULUS (MPa) | 7.0 | 8.0 | 9.0 | 4.0 | 5.0 | 2.0 | 2.2 |
| STRESS AT BREAK (MPa) | 8.0 | 5.0 | 2.5 | 22.0 | 20.0 | 25.0 | 23.0 |
| ELONGATION AT BREAK (%) | 321 | 320 | 280 | 560 | 450 | 500 | 480 |
| SURFACE TACKINESS BEFORE ULTRAVIOLET RAY IRRDAIATION | C | C | C | C | C | C | C |
| SURFACE TACKINESS AFTER ULTRAVIOLET RAY IRRADIATION AFTER 3-DAY MATURING | A | A | A | B | B | B | B |
| LOW TEMPERATURE BENDING PROPERTY BEFORE ULTRAVIOLET RAY IRRADIATION | A | A | A | A | A | A | A |
| LOW TEMPERATURE BENDING PROPERTY AFTER ULTRAVIOLET RAY IRRADIATION AFTER 3-DAY MATURING | A | A | A | A | A | A | A |

TABLE 3

| | COMPARATIVE EXAMPLE 1 | COMPARATIVE EXAMPLE 2 | COMPARATIVE EXAMPLE 3 | COMPARATIVE EXAMPLE 4 | COMPARATIVE EXAMPLE 5 |
|---|---|---|---|---|---|
| TYPE OF URETHANE PREPOLYMER | (2) | (3) | (4) | (5) | (5) |
| (HEA/NCO) × 100 (%) | 10 | 20 | 45 | 100 | 100 |
| AMOUNT USED (PARTS BY MASS) | 100 | 100 | 100 | 100 | 100 |
| TYPE OF COLORING AGENT | (X) | (X) | (X) | (X) | (X) |
| AMOUNT USED (PARTS BY MASS) | 16.6 | 16.4 | 16.2 | 16.5 | 16.5 |
| TMPTA (PARTS BY MASS) | — | — | — | — | 8.3 |
| IRGACURE 819 (PARTS BY MASS) | 0.83 | 0.82 | 0.81 | 0.83 | 0.83 |
| IRGACURE 651 (PARTS BY MASS) | 0.83 | 0.82 | 0.81 | 0.83 | 0.83 |
| 100% MODULUS (MPa) | 2.7 | 2.4 | 1.7 | 1.8 | 3.9 |
| STRESS AT BREAK (MPa) | 26.0 | 17.5 | 7.0 | 5.0 | 8.7 |
| ELONGATION AT BREAK (%) | 846 | 760 | 432 | 223 | 173 |
| SURFACE TACKINESS BEFORE ULTRAVIOLET RAY IRRDAIATION | D | D | D | D | D |
| SURFACE TACKINESS AFTER ULTRAVIOLET RAY IRRADIATION AFTER 1-DAY MATURING | D | D | D | D | D |
| SURFACE TACKINESS AFTER ULTRAVIOLET RAY IRRADIATION AFTER 2-DAY MATURING | D | D | D | D | D |
| SURFACE TACKINESS AFTER ULTRAVIOLET RAY IRRADIATION AFTER 3-DAY MATURING | C | C | C | B | C |
| LOW TEMPERATURE BENDING PROPERTY BEFORE ULTRAVIOLET RAY IRRADIATION | A | A | A | D | D |
| LOW TEMPERATURE BENDING PROPERTY AFTER ULTRAVIOLET RAY IRRADIATION AFTER 3-DAY MATURING | A | A | A | D | D |

| | COMPARATIVE EXAMPLE 6 | COMPARATIVE EXAMPLE 7 | COMPARATIVE EXAMPLE 8 | COMPARATIVE EXAMPLE 9 |
|---|---|---|---|---|
| TYPE OF URETHANE PREPOLYMER | (5) | (1) | (2) | (3) |
| (HEA/NCO) × 100 (%) | 100 | 0 | 10 | 20 |
| AMOUNT USED (PARTS BY MASS) | 100 | 100 | 100 | 100 |
| TYPE OF COLORING AGENT | (X) | (X) | — | — |
| AMOUNT USED (PARTS BY MASS) | 16.5 | 16.7 | — | — |
| TMPTA (PARTS BY MASS) | 16.5 | 8.3 | — | — |
| IRGACURE 819 (PARTS BY MASS) | 0.83 | 0.83 | 0.83 | 0.83 |
| IRGACURE 651 (PARTS BY MASS) | 0.83 | 0.83 | 0.83 | 0.83 |
| 100% MODULUS (MPa) | Break | 2.0 | 1.8 | 6.0 |

TABLE 3-continued

| | | | | |
|---|---|---|---|---|
| STRESS AT BREAK (MPa) | 10.4 | 15.0 | 16.0 | 11.0 |
| ELONGATION AT BREAK (%) | 102 | 560 | 1091 | 560 |
| SURFACE TACKINESS BEFORE ULTRAVIOLET RAY IRRDAIATION | D | D | D | D |
| SURFACE TACKINESS AFTER ULTRAVIOLET RAY IRRADIATION AFTER 1-DAY MATURING | D | C | C | C |
| SURFACE TACKINESS AFTER ULTRAVIOLET RAY IRRADIATION AFTER 2-DAY MATURING | D | C | C | C |
| SURFACE TACKINESS AFTER ULTRAVIOLET RAY IRRADIATION AFTER 3-DAY MATURING | B | C | C | C |
| LOW TEMPERATURE BENDING PROPERTY BEFORE ULTRAVIOLET RAY IRRADIATION | D | D | A | A |
| LOW TEMPERATURE BENDING PROPERTY AFTER ULTRAVIOLET RAY IRRADIATION AFTER 3-DAY MATURING | D | C | A | A |

TABLE 4

| | COMPARATIVE EXAMPLE 10 | COMPARATIVE EXAMPLE 11 | COMPARATIVE EXAMPLE 12 | COMPARATIVE EXAMPLE 13 | COMPARATIVE EXAMPLE 14 |
|---|---|---|---|---|---|
| TYPE OF URETHANE PREPOLYMER | (4) | (5) | (7) | (8) | (9) |
| (HEA/NCO) × 100 (%) | 45 | 100 | 10 | 20 | 45 |
| AMOUNT USED (PARTS BY MASS) | 100 | 100 | 100 | 100 | 100 |
| TYPE OF COLORING AGENT | — | — | (X) | (X) | (X) |
| AMOUNT USED (PARTS BY MASS) | — | — | 16.7 | 16.6 | 16.6 |
| TMPTA (PARTS BY MASS) | — | — | — | — | — |
| IRGACURE 819 (PARTS BY MASS) | 0.83 | 0.83 | 0.83 | 0.83 | 0.83 |
| IRGACURE 651 (PARTS BY MASS) | 0.83 | 0.83 | 0.83 | 0.83 | 0.83 |
| 100% MODULUS (MPa) | 1.0 | 1.0 | 4.4 | 3.2 | 3.0 |
| STRESS AT BREAK (MPa) | 1.0 | 0.8 | 28.2 | 17.5 | 6.1 |
| ELONGATION AT BREAK (%) | 429 | 212 | 662 | 800 | 384 |
| SURFACE TACKINESS BEFORE ULTRAVIOLET RAY IRRDAIATION | D | D | D | D | D |
| SURFACE TACKINESS AFTER ULTRAVIOLET RAY IRRADIATION AFTER 1-DAY MATURING | C | D | D | D | D |
| SURFACE TACKINESS AFTER ULTRAVIOLET RAY IRRADIATION AFTER 2-DAY MATURING | C | C | D | D | D |
| SURFACE TACKINESS AFTER ULTRAVIOLET RAY IRRADIATION AFTER 3-DAY MATURING | C | C | C | C | C |
| LOW TEMPERATURE BENDING PROPERTY BEFORE ULTRAVIOLET RAY IRRADIATION | A | D | A | A | A |
| LOW TEMPERATURE BENDING PROPERTY AFTER ULTRAVIOLET RAY IRRADIATION AFTER 3-DAY MATURING | A | D | A | A | A |

| | COMPARATIVE EXAMPLE 15 | COMPARATIVE EXAMPLE 16 | COMPARATIVE EXAMPLE 17 | COMPARATIVE EXAMPLE 18 |
|---|---|---|---|---|
| TYPE OF URETHANE PREPOLYMER | (10) | (10) | (10) | (11) |
| (HEA/NCO) × 100 (%) | 100 | 100 | 100 | 20 |
| AMOUNT USED (PARTS BY MASS) | 100 | 100 | 100 | 100 |
| TYPE OF COLORING AGENT | (X) | (X) | (X) | (X) |
| AMOUNT USED (PARTS BY MASS) | 16.5 | 16.5 | 16.5 | 16.6 |
| TMPTA (PARTS BY MASS) | — | 8.3 | 16.5 | — |
| IRGACURE 819 (PARTS BY MASS) | 0.83 | 0.83 | 0.83 | 0.83 |
| IRGACURE 651 (PARTS BY MASS) | 0.83 | 0.83 | 0.83 | 0.83 |
| 100% MODULUS (MPa) | 2.7 | 11.0 | Break | 2.3 |
| STRESS AT BREAK (MPa) | — | — | — | 28.0 |
| ELONGATION AT BREAK (%) | 137 | 65 | 23 | 680 |
| SURFACE TACKINESS BEFORE ULTRAVIOLET RAY IRRDAIATION | D | C | C | C |

TABLE 4-continued

| | | | | |
|---|---|---|---|---|
| SURFACE TACKINESS AFTER ULTRAVIOLET RAY IRRADIATION AFTER 1-DAY MATURING | D | D | D | D |
| SURFACE TACKINESS AFTER ULTRAVIOLET RAY IRRADIATION AFTER 2-DAY MATURING | D | D | D | D |
| SURFACE TACKINESS AFTER ULTRAVIOLET RAY IRRADIATION AFTER 3-DAY MATURING | C | C | B | B |
| LOW TEMPERATURE BENDING PROPERTY BEFORE ULTRAVIOLET RAY IRRADIATION | D | D | D | A |
| LOW TEMPERATURE BENDING PROPERTY AFTER ULTRAVIOLET RAY IRRADIATION AFTER 3-DAY MATURING | D | D | D | A |

TABLE 5

| | COMPARATIVE EXAMPLE 19 | COMPARATIVE EXAMPLE 20 | COMPARATIVE EXAMPLE 21 | COMPARATIVE EXAMPLE 22 |
|---|---|---|---|---|
| TYPE OF URETHANE PREPOLYMER | (13) | (13) | (13) | (14) |
| (HEA/NCO) × 100(%) | 20 | 20 | 20 | 20 |
| AMOUNT USED (PARTS BY MASS) | 100 | 100 | 100 | 100 |
| TYPE OF COLORING AGENT | (X) | (X) | (X) | — |
| AMOUNT USED (PARTS BY MASS) | 16.6 | 16.6 | 16.6 | — |
| TMPTA (PARTS BY MASS) | — | 8.3 | 16.6 | 8.6 |
| IRGACURE 819 (PARTS BY MASS) | 0.83 | 0.83 | 0.83 | 0.86 |
| IRGACURE 651 (PARTS BY MASS) | 0.83 | 0.83 | 0.83 | 0.86 |
| 100% MODULUS (MPa) | 1.5 | 2.0 | 3.0 | — |
| STRESS AT BREAK (MPa) | 18.0 | 16.0 | 13.0 | — |
| ELONGATION AT BREAK (%) | 850 | 650 | 320 | 10 |
| SURFACE TACKINESS BEFORE ULTRAVIOLET RAY IRRDAIATION | D | D | D | C |
| SURFACE TACKINESS AFTER ULTRAVIOLET RAY IRRADIATION AFTER 3-DAY MATURING | C | C | B | B |
| LOW TEMPERATURE BENDING PROPERTY BEFORE ULTRAVIOLET RAY IRRADIATION | D | D | D | D |
| LOW TEMPERATURE BENDING PROPERTY AFTER ULTRAVIOLET RAY IRRADIATION AFTER 3-DAY MATURING | A | A | D | D |

Here, in Tables 1 to 5, ((HEA/NCO)×100) represents the ratio of the number of the isocyanate groups with which the hydroxyl groups in 2-hydroxyethylacrylate were reacted based on the entire amount of the number of the isocyanate groups in the urethane prepolymer. The coloring Agent (X) shows the coloring agent that was obtained in Synthesis Example 15. The coloring Agent (Y) shows the coloring agent that was obtained in Synthesis Example 16. "TMPTA" is trimethylolpropanetriacrylate. "IRGACURE 819" is a photopolymerization initiator manufactured by Ciba Specialty Chemicals K.K. "IRGACURE 651" is a photopolymerization initiator manufactured by Ciba Specialty Chemicals K.K.

The leather-like sheet in the present invention can be applied in a broad range of usage such as shoes, furniture, clothes, vehicles, bags, and storage cases for example.

What is claimed is:

1. A leather-like sheet comprising a substrate layer and a surface skin layer, wherein said surface skin layer is composed of a cross-linked product of a polyurethane hot-melt composition containing 100 parts by mass of a urethane prepolymer (A), 5 parts by mass to 40 parts by mass of a coloring agent (B) containing a polyol as a vehicle, 5 parts by mass to 50 parts by mass of a multi-functional (meth)acrylate (C), and 0.5 parts by mass to 5 parts by mass of a photopolymerization initiator (D), and wherein said urethane prepolymer (A) is obtained by reacting 5% to 50% of the number of isocyanate groups in a urethane prepolymer containing isocyanate groups that is obtained by reacting a polyol (a1) containing 40% by mass or more of a polytetramethylene glycol and a polyisocyanate (a2) with a (meth)acrylate containing a hydroxyl group.

2. The leather-like sheet according to claim 1, wherein said polyol (a1) further contains a polyester polyol (a3) that is obtained by reacting an alkylene oxide adduct of bisphenol A with a polycarboxylic acid in the range of 10% by mass to 60% by mass.

3. The leather-like sheet according to claim 1, wherein said multi-functional (meth)acrylate (C) is one type or more selected from the group consisting of trimethylolpropanetriacrylate, pentaerythritoltriacrylate, an ethylene oxide adduct thereof, and a propylene oxide adduct thereof.

4. The leather-like sheet according to claim 1, wherein the softening point of said urethane prepolymer (A) is 40° C. to 120° C.

5. The leather-like sheet according to claim 1, wherein the 100% modulus of said surface skin layer is in the range of 1.0 MPa to 8.0 MPa.

6. The leather-like sheet according to claim 1, further comprising an intermediate layer between said substrate layer and said surface skin layer.

7. The leather-like sheet according to claim 6, wherein said intermediate layer is a porous layer composed of a polyurethane resin.

8. The leather-like sheet according to claim 1, wherein said vehicle is a polyalkylene glycol or a urethane modified polyol.

* * * * *